United States Patent [19]

Klappenecker

[11] Patent Number: 4,993,319

[45] Date of Patent: Feb. 19, 1991

[54] IMPRINTING DEVICE EQUIPPED WITH AN ADJUSTABLE COUNTERPRESSURE CYLINDER

[75] Inventor: Karl Klappenecker, Konstanz, Fed. Rep. of Germany

[73] Assignee: Licentia Patent-Verwaltungs-GmbH, Frankfurt, Fed. Rep. of Germany

[21] Appl. No.: 342,862

[22] Filed: Apr. 25, 1989

[51] Int. Cl.[5] ..... B41F 5/00

[52] U.S. Cl. ..... 101/216; 101/233

[58] Field of Search ..... 101/233, 234, 235, 247, 101/216, 232; 400/56

[56] References Cited

U.S. PATENT DOCUMENTS

| | | | |
|---|---|---|---|
| 1,702,763 | 2/1929 | Clark | 101/234 |
| 2,152,204 | 3/1939 | Moore | 101/234 |
| 4,037,535 | 7/1977 | Lehman et al. | 101/233 |
| 4,054,092 | 10/1977 | Loftus et al. | 101/235 |
| 4,079,669 | 3/1978 | Nyborg | 101/235 |
| 4,121,716 | 10/1978 | Luperti et al. | 101/233 |
| 4,437,484 | 3/1984 | Laing et al. | 137/99 |
| 4,461,212 | 7/1984 | Geney | 101/234 |
| 4,763,575 | 8/1988 | Miciukiewicz | 101/235 |

FOREIGN PATENT DOCUMENTS

| | | | |
|---|---|---|---|
| 2591944 | 4/1987 | France | 101/234 |
| 0041265 | 4/1984 | Japan | 101/233 |
| 1094863 | 12/1967 | United Kingdom | 101/234 |

*Primary Examiner*—Edgar S. Burr
*Assistant Examiner*—Joseph R. Keating
*Attorney, Agent, or Firm*—Spencer & Frank

[57] ABSTRACT

In an imprinting device including a pressure cylinder and a movable counterpressure cylinder, the counterpressure cylinder is disposed opposite the pressure cylinder and is elastically attached to a rocker which is pivotal about a point. The device includes at least one electro-dynamic actuator so as to vary the axial distance between the pressure cylinder and the counterpressure cylinder in that the actuators move the rocker about its pivot point.

5 Claims, 3 Drawing Sheets

IMPRINTING DEVICE EQUIPPED WITH AN ADJUSTABLE COUNTERPRESSURE CYLINDER

BACKGROUND OF THE INVENTION

1. Field of the Invention

The invention relates to an imprinting device and more specifically an imprinting device for cancelling postage stamps on letters and other mail items or for imprinting documents of different thicknesses.

DISCUSSION OF THE BACKGROUND

Imprinting devices are disclosed, for example, in U.S. Pat. No. 4,461,212 and are composed of two rollers or cylinders of which one is configured as a rotary stamp and the other as a counterpressure cylinder which is provided to establish sufficient contact between the pressure cylinder and the object to be printed in order to stamp or imprint the respective object and control the movement of the object through the cylinder pair. In order to process objects or items of mail to be imprinted where such items have different thicknesses, the passage channel between stamp and counterpressure cylinder must be adjustable by means of a mechanical retraction movement of one or both cylinders as a function of the thickness of the object and simultaneously the contact pressure must be kept approximately constant. As described in the above-mentioned publication, this can be accomplished in that the counterpressure cylinder is held in form-locking contact with the respective object, for example, by spring force and the axial distance between the two cylinders is increased or decreased corresponding to the thickness of the object. Since broadening of the channel width between the two cylinders is effected in a force-locking manner, one drawback of such a structure is that, with thicker objects and at the processing rates of more than three meters per second as are customary in postal operation, great forces may act intermittently on the cylinders, particularly on their surfaces and on the object being imprinted causing damage to the imprinting device and/or the object being imprinted, as well as increased wear and noise development may occur. Additionally, the above measures do not permit accurate positioning of the imprint on the object which is a particular drawback for stamping devices used to cancel postage stamps.

Another possibility for varying the width of the passage channel between the two cylinders according to the thickness of the object is to measure the thickness, before the object reaches the pair of cylinders, by means of a sensing roller and make a preliminary compensation by mechanical means. In this case, the sensing roller will be put in motion by items which exceed a certain thickness and this movement is utilized to displace the counterpressure cylinder and thus increase the clearance between the surfaces of the stamping cylinder and the counterpressure cylinder. However, the adjustment device must press against the compression spring of the counterpressure cylinder so that wear and noise problems will occur. Moreover, this system requires a complicated mechanism to keep the passage channel open until the object to be imprinted has left the region of the stamping cylinder since the counterpressure cylinder must not jump back into its original position when the trailing edge of the object leaves the pickup range of the sensing roller.

SUMMARY OF THE INVENTION

It is an object of the present invention to create an imprinting device which avoids the above-mentioned drawbacks, has a simple and robust mechanical structure in which the costs for the displacement mechanism are transferred to an electronic system and which permits, even at high processing rates, preliminary adaptation of the passage channel width in accordance with the thickness of the items to be imprinted or stamped.

This is accomplished according to the invention by an imprinting device having a first pivot, a first rocker which moves about the first pivot, an electrodynamic actuator means for moving the first rocker about the first pivot, a counterpressure cylinder attached to the first rocker, and a pressure cylinder which imprints the article, opposing and spaced from the counterpressure cylinder. The motion of the first rocker about the first pivot varies the distance of the counterpressure cylinder from the pressure cylinder.

BRIEF DESCRIPTION OF THE DRAWINGS

In order to explain the invention in greater detail, a preferred embodiment thereof will now be described with reference to the drawing figures.

DETAILED DESCRIPTION OF THE PREFERRED EMBODIMENTS

Figure 1:
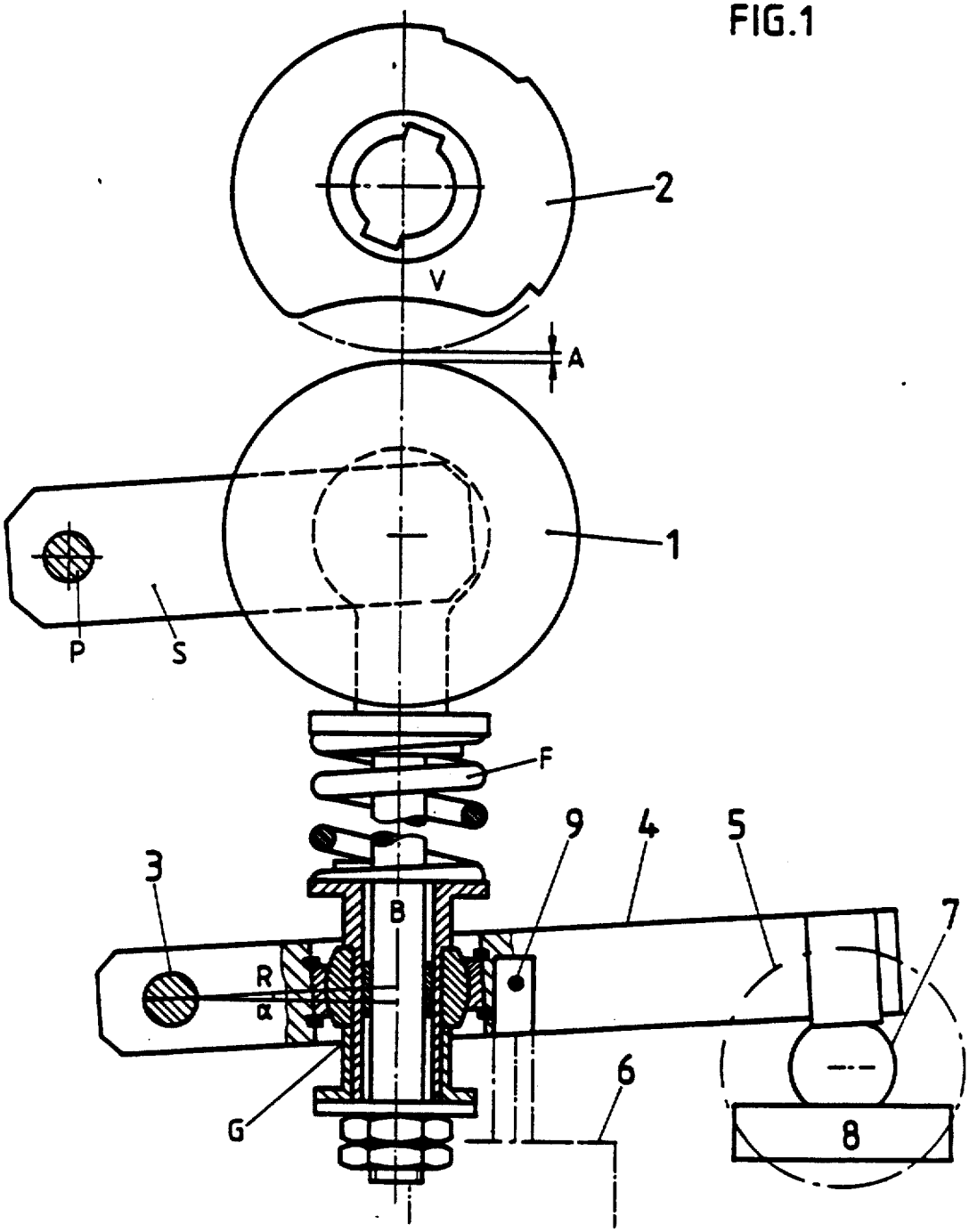
FIG. 1 is a schematic and partially sectional elevational view of an imprinting device according to the invention with the passage channel having a small width.
Figure 2:
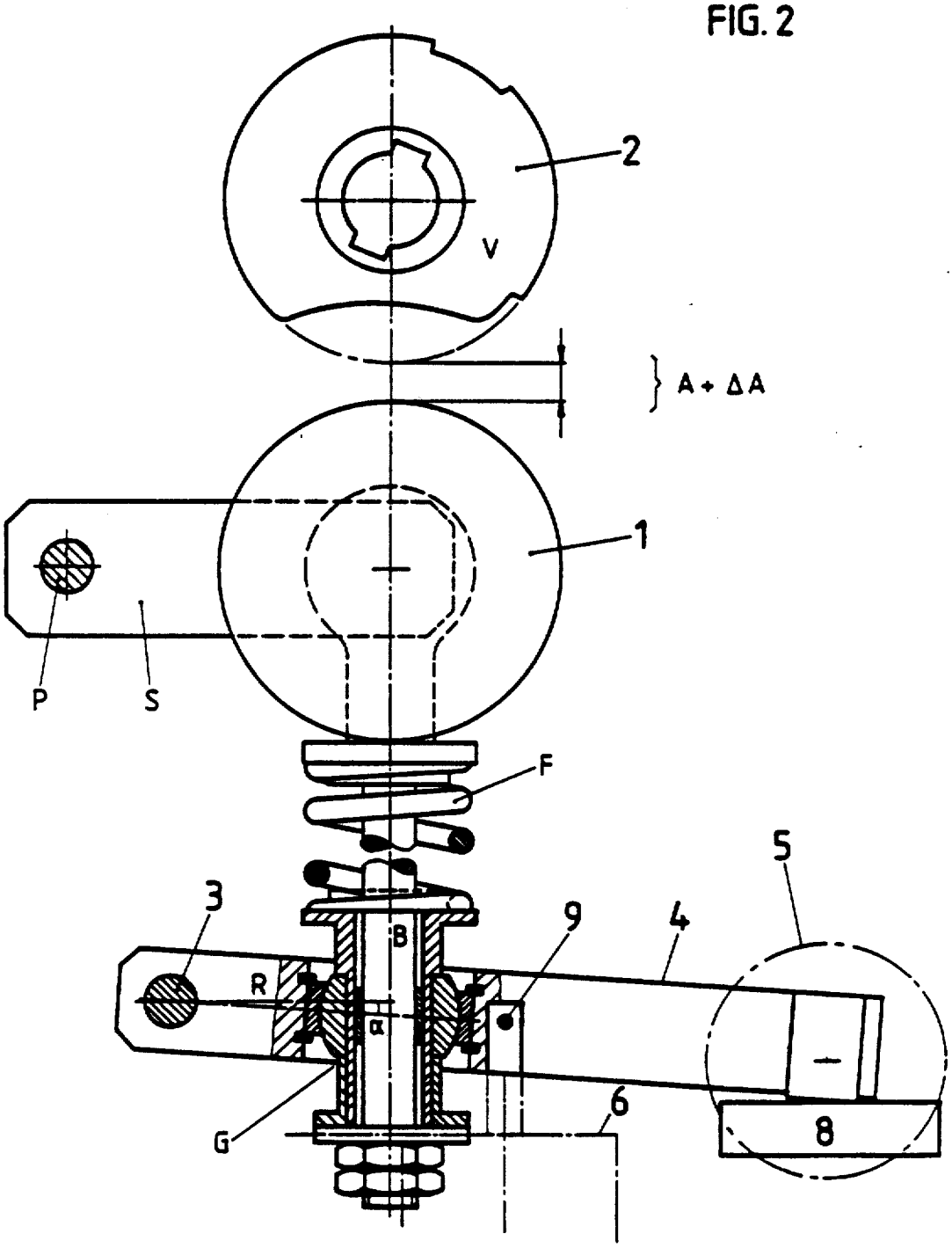
FIG. 2 depicts the imprinting device of FIG. 1 with the width of the passage channel increased.

According to FIG. 1, the imprinting device is composed of a counterpressure cylinder 1 which is arranged opposite a rotary stamp 2 and is held by a rocker S movable about its pivot point P. The rocker moves in a plane parallel to the place of the drawing. Counterpressure cylinder 1 is held elastically by means of a pin B equipped with a spring F which both lie in the extension of the connecting line V between the axes of cylinders 1 and 2. Pin B guides spring F. During the imprinting process, spring F causes cylinder 1 to contact the object to be imprinted with a pressure force of about 100 Newton and to additionally produce a fine adjustment of the width of the passage channel. A pivot bearing G is disposed in the lower portion of pin B; it couples the mentioned pin with a rocker 4 which is able to pivot about a point 3. Movement of rocker 4 about point 3 permits a change in the equilibrium position of cylinder 1 and thus a change in the clearance A between it and cylinder 2. By selection of the rotation angle $\alpha'=\alpha$ (FIG. 2) it is accomplished that pin B lies on the above-mentioned extension of connecting line V even if it is in the position identified by angle $\alpha'$ and thus no additional positioning problems occur. Movement of rocker 4 is controlled by a reversing stroke magnet 6. In order to widen the channel width A, reversing magnet 5 pulls a detent pin 7 upwardly and then the rocker is pivoted about its pivot point 3 against a stop 8. Distance A is thus increased by approximately $A=(\alpha+\alpha')\cdot R$, where R is the distance between pivot point 3 and the axis of symmetry of pin B. For a reversing of the movement, reversing magnet 6, which is coupled with the pivot joint 9 of rocker 4, is activated first and then the detent pin 7 charged by magnet 5 secures the end position of rocker 4. The sequence of these movements is controlled electronically.

Figure 3:
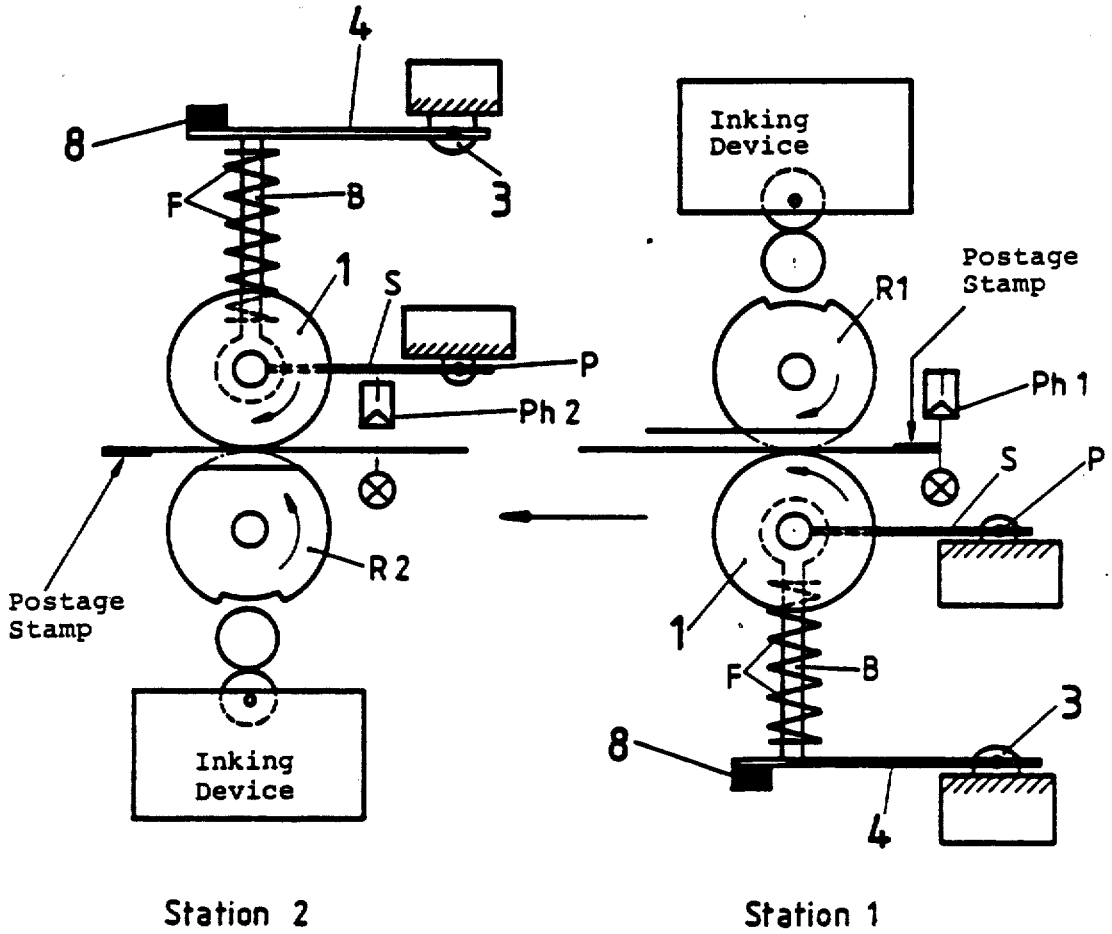
FIG. 3 is a schematic representation of a stamping module composed of two devices according to FIGS. 1 and 2.

The operation of the device will now be described with reference to its preferred use in a stamping module for the cancellation of postage stamps (FIG. 3). The stamping module includes two stamping units, station 1 and station 2. During the cancellation process, the mail shipments are disposed upside down. Which station does the cancelling depends on which side of the shipment bears the postage stamp. To prevent smudging of the cancellation imprint, the rate of rotation of the permanently rotating counterpressure cylinder and of the stamp must be as identical as possible which can be ensured by mechanical or electronic control means. A pickup cylinder equipped with sensors determines the thickness of an item already before the item reaches the stamping module. By way of a shift register, the item carried by covering belts can be monitored until it reaches the stamping module and the width of the passage channel of the respective stamping station can be increased or decreased in accordance with the thickness of the item as soon as the leading edge of the item blocks the beam of a photocell PH1 or PH2, respectively. Simultaneous with this action, rotary stamp R1 or R2, respectively, begins to rotate, with the imprinting process in station 1 being initiated by the trailing edge of an item, in station 2 by the leading edge. For use of the device in a stamping module according to FIG. 3, the primary advantage is the short delay realizable with bistable reversing magnets. With the items traveling at a speed of about 3 m/s, the time available for the described movements is short if the objects vary in thickness. Let it be assumed that, initially, the passage channel is open to imprint a thick item. Then, let it be assumed that the next item is, for example, a postcard, so that the channel must be made narrower. The counterpressure cylinder must move only after the trailing edge of the thick item has left the stamping region. But it must be in position at the latest when the postcard is in the stamping position. This results in requirements for switching times on the order of tenth of seconds which can easily be maintained with reversing times of 10 milliseconds as they are produced by conventional reversing magnets.

I claim:

1. Imprinting device comprising:
a rotary stamp;
a rocker pivoting around a first point;
a counterpressure cylinder disposed a distance from the rotary stamp;
means for elastically attaching the counterpressure cylinder to the rocker comprising a spring and a means for guiding the spring, the counterpressure cylinder thereby moving toward and away from the rotary stamp;
a stop; and
a detent pin associated with the stop, the detent pin interposed between the rocker and the stop defining a first terminal position for the rocker, and the detent pin removed from between the rocker and the stop, whereby the rocker contacts the stop, defining a second terminal position for the rocker, whereby the distance between the counterpressure cylinder and the rotary stamp is decreased and increased, respectively.

2. Imprinting device according to claim 1, further comprising at least one bistable, reversing stroke magnet the detent pin being interposed and removed from between the rocker and the stop by the bistable magnet.

3. Imprinting device according to claim 1, wherein the rocker is a first rocker further comprising a second rocker which is pivotal about a second point, the counterpressure cylinder being attached to said second rocker, said second rocker being disposed between the counterpressure cylinder and the first rocker.

4. Imprinting device according to claim 1, further comprising an electronic sensor wherein the distance between the pressure cylinder and the counterpressure cylinder is increased or decreased as a function of the thickness of the objects to be imprinted and is controlled by the electronic sensor which actuates the bistable magnet.

5. The device defined in claim 1, further comprising a pin attaching the counterpressure cylinder to the rocker, the spring surrounding the pin.

* * * * *